US010289053B2

(12) United States Patent
Iguchi

(10) Patent No.: US 10,289,053 B2
(45) Date of Patent: May 14, 2019

(54) IMAGE FORMING APPARATUS AND METHOD OF CONTROLLING AN IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Ken Iguchi, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 38 days.

(21) Appl. No.: 15/276,438

(22) Filed: Sep. 26, 2016

(65) Prior Publication Data

US 2018/0088515 A1 Mar. 29, 2018

(51) Int. Cl.

| | |
|---|---|
| ***B65H 7/00*** | (2006.01) |
| ***G03G 15/00*** | (2006.01) |
| ***B65H 35/00*** | (2006.01) |
| ***B65H 37/04*** | (2006.01) |
| ***B65H 37/06*** | (2006.01) |
| *G03G 21/00* | (2006.01) |

(52) U.S. Cl.

CPC ..... *G03G 15/6582* (2013.01); *B65H 7/00* (2013.01); *B65H 35/0006* (2013.01); *B65H 37/04* (2013.01); *B65H 37/06* (2013.01); *G03G 15/6508* (2013.01); *G03G 15/6538* (2013.01); *G03G 15/6588* (2013.01); *B65H 2301/45* (2013.01); *B65H 2301/515* (2013.01); *B65H 2301/51611* (2013.01); *G03G 21/00* (2013.01)

(58) Field of Classification Search

CPC ..... G03G 15/6508; G03G 15/6582; B41M 7/0009

See application file for complete search history.

(56) References Cited

U.S. PATENT DOCUMENTS

| | | | | |
|---|---|---|---|---|
| 8,537,383 | B2 | 9/2013 | Iguchi et al. | |
| 8,542,373 | B2 * | 9/2013 | Suzuki | B41M 7/0009 358/1.1 |
| 8,717,618 | B2 | 5/2014 | Iguchi et al. | |
| 9,233,552 | B2 | 1/2016 | Yahata | |
| 2002/0051666 | A1 * | 5/2002 | Asai | G03G 15/6508 399/391 |
| 2011/0234721 | A1 | 9/2011 | Endo | |

* cited by examiner

*Primary Examiner* — Jennifer E Simmons
(74) *Attorney, Agent, or Firm* — Kim & Stewart LLP

(57) ABSTRACT

An image forming apparatus includes a first sheet storage, a second sheet storage, an image forming unit, a sheet conveyer configured to convey sheets from the first and second sheet storages to the image forming unit, and a controller. The controller is configured to set new sheets as a type of sheets stored in the first sheet storage and image-decolored sheets as a type of sheets stored in the second sheet storage, switch a sheet feeding source from the first sheet storage to the second sheet storage when the first sheet storage runs out of sheets during execution of a first image forming job that includes no sheet post-processing, and stop image forming by the image forming unit when the first sheet storage runs out of sheets during execution of a second image forming job that includes sheet post-processing.

20 Claims, 8 Drawing Sheets

IMAGE FORMING APPARATUS AND METHOD OF CONTROLLING AN IMAGE FORMING APPARATUS

FIELD

Embodiments described herein relate generally to a technique of switching a paper feed cassette of an image forming apparatus.

BACKGROUND

An image forming apparatus includes a plurality of paper feed cassettes. The image forming apparatus sets a sheet size which is different for each cassette and determines a cassette from which sheets are fed according to a sheet size designated in a job.

To the contrary, there is another type of image forming apparatus which sets a same sheet size for a plurality of cassettes and is capable of continuing to feed sheets from another cassette when one cassette runs out of sheets during execution of a job. For example, the image forming apparatus set A4-size for two cassettes of a first cassette and a second cassette as the size of the sheets. When the image forming apparatus executes a job of printing A4-size sheets, the image forming apparatus starts printing of A4-size sheets from the first cassette and then continues to feed sheets from the second cassette when the first cassette runs out of sheets during the printing. This function is referred to as an automatic switching function.

Meanwhile, there is a system that carries out a decoloring process so that a sheet can be reused, when a decolorable image is formed on the sheet by an image forming apparatus and the image is no longer needed.

Here, it is assumed that image formation using a decolorable toner is carried out on a plurality of sheets and then the sheets are bundled by stapling the sheets according to a job. When the bundled sheets are no longer needed and a decoloring process is performed on the sheets that are unbundled using a decoloring device, a folded portion or the like is frequently formed in the stapled portions. Further, bundled sheets on which an image is formed using a decolorable toner and which was subjected to post-processing such as a punching process (punching) or a center folding process (process of bundling sheets and folding the central portion thereof) is not suitable for reuse because punched holes or folded portions exist in the sheets.

Sheets (successfully) subjected to the decoloring process (hereinafter, referred to as reuse sheets) may include sheets which have been subjected to a printing process plural times and have a plurality of toner layers stacked thereon. Since the reuse sheets are sheets on which the printing process and the decoloring process are performed at least once, respectively, the sheets may not be in an excellent state. When post-processing is performed on such sheets, the positions of holes made through the punching may be shifted, and the sheets are not aligned properly during the stapling. As a result, the post-processing may not be carried out precisely.

In light of the above, the following situation is assumed. That is, in an image forming apparatus having the automatic switching function, a first cassette stores new sheets and a second cassette stores reuse sheets of the same size as the new sheets, and the image forming apparatus executes a printing job including post-processing. The reuse sheets from the second cassette are used when the first cassette runs out of new sheets during execution of the job and the first cassette is switched to the second cassette according to the automatic switching function. Since the precision of the post-processing is decreased for the reason as described above when reuse sheets are used, a sheet bundle (document) created as a result may not be in a best quality.

DETAILED DESCRIPTION

Figure 1:
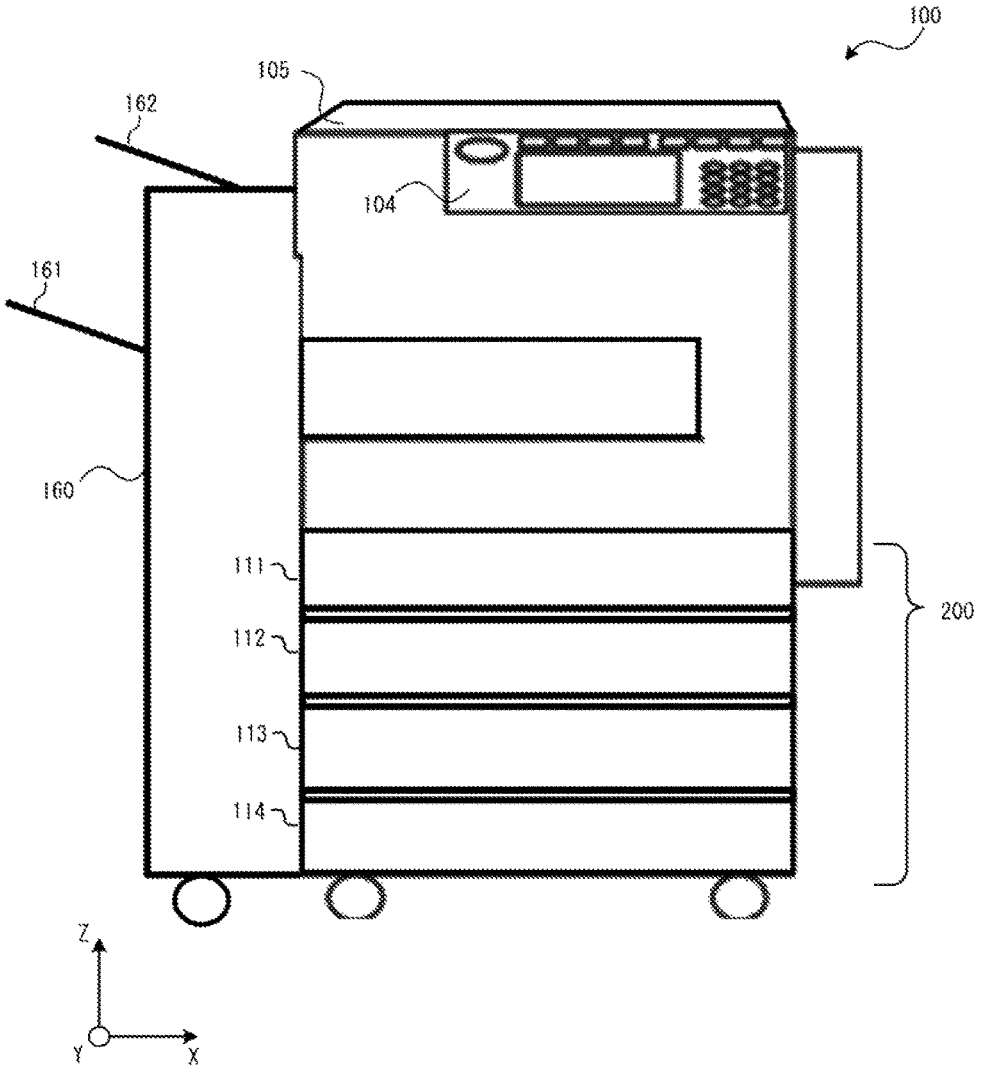
FIG. 1 is an external view of an image forming apparatus.

In general, according to an embodiment, an image forming apparatus includes a first sheet storage, a second sheet storage, an image forming unit, a sheet conveyer configured to convey sheets from the first and second sheet storages to the image forming unit, and a controller. The controller is configured to set new sheets as a type of sheets stored in the first sheet storage and image-decolored sheets as a type of sheets stored in the second sheet storage, switch a sheet feeding source from the first sheet storage to the second sheet storage when the first sheet storage runs out of sheets during execution of a first image forming job that includes no sheet post-processing, and stop image forming by the image forming unit when the first sheet storage runs out of sheets during execution of a second image forming job that includes sheet post-processing. In setting a paper feed cassette, the image forming apparatus according to the embodiment can set the sheet size and set whether or not the cassette stores reuse sheets. The image forming apparatus according to the embodiment determines whether a job to be executed includes post-processing after an image forming process and determines whether to perform or prohibit automatic switching to a cassette that stores reuse sheets. The image forming apparatus according to the embodiment prohibits an automatic switching operation when the job includes post-processing. The image forming apparatus permits the automatic switching operation when the job includes no post-processing.

The image forming apparatus according to the embodiment permits or prohibits the automatic switching operation of switching to a cassette that stores reuse sheets based on the type of the post-processing.

The image forming apparatus according to the embodiment can perform both of printing using a decolorable color material and printing using a non-decolorable color material. The decolorable color material is fixed onto a sheet at a prescribed fixing temperature or higher, and the decolorable color material is decolored when heated at a prescribed decoloring temperature or higher which is higher than or equal to the prescribed fixing temperature. The decolorable color material includes a coloring compound, a developer, and a decoloring agent. A leuco dye may be used as the coloring compound. Phenols may be used as the developer. A substance which is compatible with a coloring compound when heated and does not have an affinity with a developer may be used as the decoloring material. The decolorable color material is colored due to an interaction between a coloring compound and a developer and decolored due to a disablement of the interaction between the coloring compound and the developer when heated at a decoloring temperature or higher.

In the embodiment, a toner is used as an example of a color material, but an aspect of the embodiment is applicable also when an image forming process is performed using an ink. The term "decoloring" in the embodiment corresponds to making an image of colors (including chromatic colors as well as achromatic colors such as white and black) different from the color of a sheet invisible. The expression "making an image invisible" may be achieved by making an image of colors different from the color of the sheet colorless (transparent) or decoloring an image of colors different from the color of the sheet to a color which is the same as or close to the color of the sheet.

Hereinafter, one or more embodiments will be described with reference to the accompanying drawings.

Figure 2:
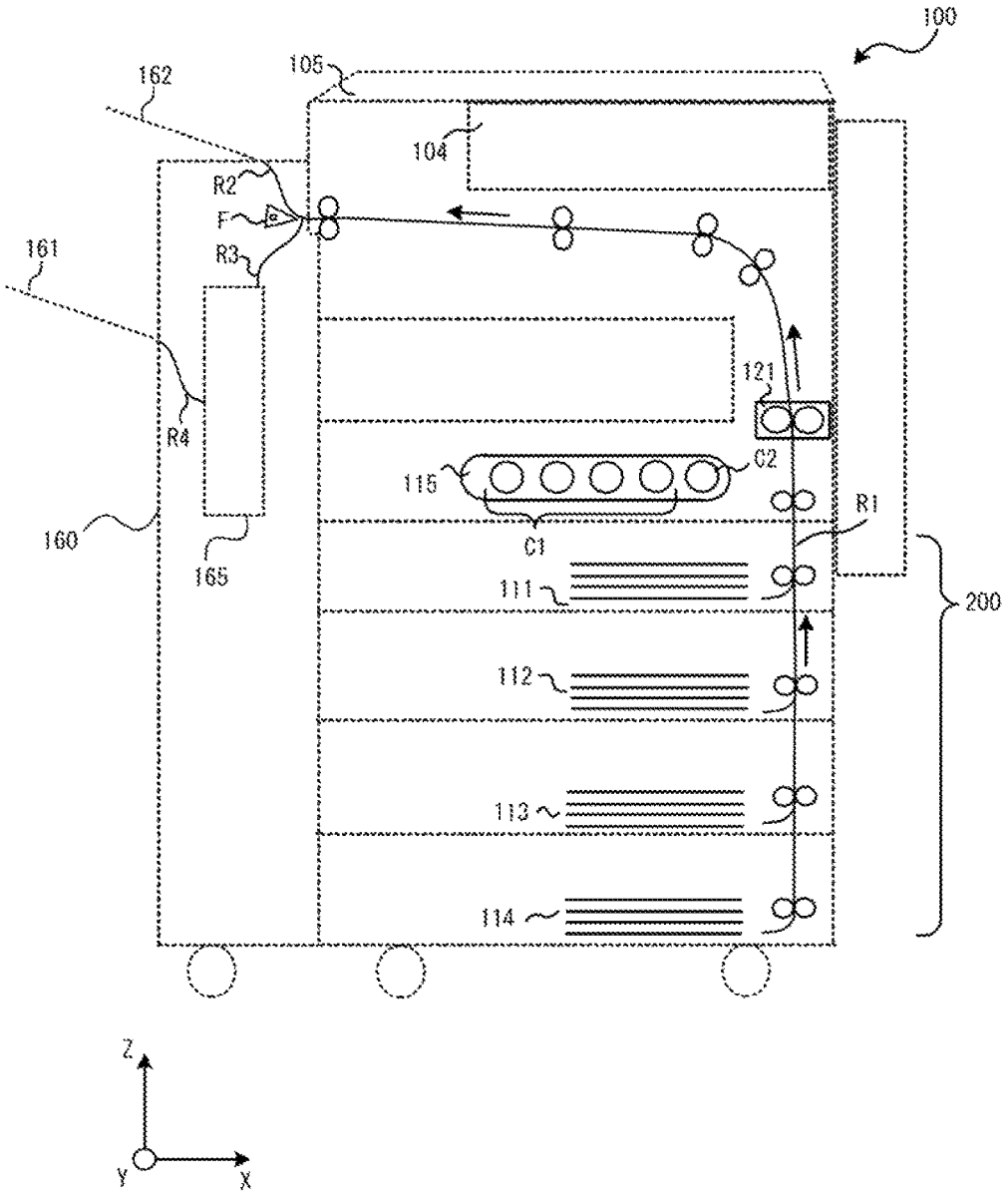
FIG. 2 schematically illustrates an internal configuration of the image forming apparatus.

FIG. 1 is an external view of an image forming apparatus according to an embodiment. FIG. 2 schematically illustrates an example of an internal configuration of the image forming apparatus. Further, an X-axis, a Y-axis, and a Z-axis of the drawings are common among the drawings. Arrows in FIG. 2 indicate a conveyance direction of sheets. Hereinafter, a configuration of an image forming apparatus 100 will be described with reference to FIG. 2.

The image forming apparatus 100 includes cassettes 111, 112, 113, and 114 which can store sheets and supply the sheets during execution of a job. The cassettes 111, 113, and 114 each store unused new sheets that are different in size. The cassette 112 stores used sheets which have been subjected to a decoloring process using a decoloring device. In the present example, the decoloring process includes a heating process performed on a sheet on which an image is formed using a decolorable color material at a prescribed decoloring temperature or higher. The sheets which have been subjected to the decoloring process are referred to as reuse sheets.

In the present embodiment, sheets stored in the cassettes 111 and 112 have the same size as each other. Hereinafter, the cassette 111 is referred to as a regular cassette 111 and the cassette 112 is referred to as a reuse cassette 112. Moreover, the cassettes 111 to 114 are collectively referred to as a paper feeding unit 200.

The image forming apparatus 100 includes an image forming unit 115 that forms an image on a sheet. The image forming unit 115 is capable of performing both of printing using a decolorable color material and printing using a non-decolorable color material. The image forming unit 115 includes cartridges C1 storing non-decolorable color materials which are typical color materials, and a cartridge C2 storing a decolorable color material which is decolored at a prescribed decoloring temperature or higher. The cartridges C1 include cartridges of respective colors of cyan, magenta, yellow, and black. Further, the image forming apparatus 100 includes a heater 121 that heats and presses a sheet on which an image is formed so that the image is fixed onto the sheet.

The image forming apparatus 100 includes a conveyance path R1 along which sheets are sequentially conveyed through the paper feeding unit 200, the image forming unit 115, the heater 121, and a post-processing device 160 described below. Moreover, the image forming apparatus 100 includes an operation panel 104 that receives, from a user, an input of parameter values such as the number of print copies or an instruction to start processing and displays a progress situation of a job. The image forming apparatus 100 also includes a scanning unit 105 that scans sheets disposed on a transparent glass plate. Image data generated by the scanning unit 105 is output to the image forming unit 115, and the image forming unit 115 forms an image corresponding to the image data on a sheet (copying).

The image forming apparatus 100 includes the post-processing device 160, which is optionally connectable thereto. The post-processing device 160 performs path switching such that sheets conveyed via the conveyance path R1 are continuously conveyed by one of a conveyance path R2 and a conveyance path R3 using a flapper F. When the sheets are conveyed by the conveyance path R2, the sheets are discharged to a discharge tray 162. Further, when the sheets are conveyed to the conveyance path R3, the post-processing unit 165 bundles plural sheets, aligns the sheet bundle, and performing post-processing of stapling or a center folding process on the sheet bundle. Moreover, punching may be carried out for each sheet as post-processing. The sheets or the sheet bundle after the post-processing is discharged to a discharge tray 161 through a conveyance path R4.

Figure 3:
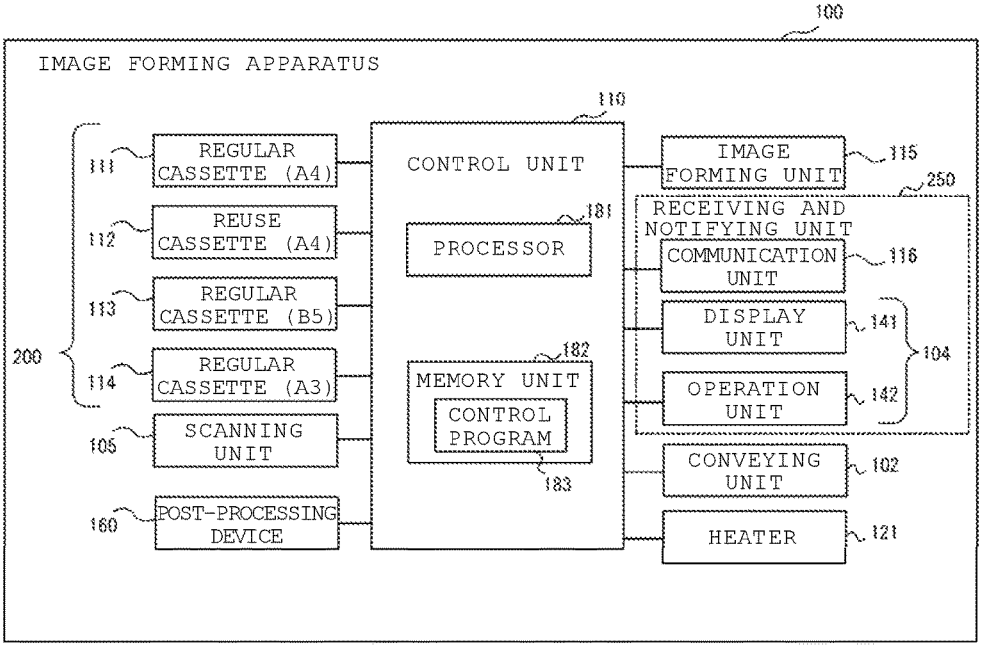
FIG. 3 is a block diagram of the image forming apparatus according to the embodiment.

FIG. 3 is a block diagram showing an example of the configuration of the image forming apparatus 100. The image forming apparatus 100 includes a control unit 110 including at least a processor 181 and a memory unit 182. The processor 181 is an arithmetic processing unit such as a central processing unit (CPU). The processor 181 performs various functions by executing programs stored in the memory unit 182. The memory unit 182 includes a main memory that stores data in a volatile manner and directly receives and outputs data from and to the processor 181. Further, the memory unit 182 includes a ROM and an auxiliary memory and stores a control program 183 or data in a non-volatile manner. The control unit 110 integrally controls the entire image forming apparatus 100 by the processor 181 executing the control program 183. Further, a part or all of the functions performed by the control unit 110 may be performed using a circuit such as an application specific integrated circuit (ASIC).

The image forming apparatus 100 includes a communication unit 116. The communication unit 116 receives print data from a personal computer based on an instruction of the control unit 110. Further, the communication unit 116 transmits a message related to processing results or state conditions to the personal computer. The image forming apparatus 100 receives print data and forms an image of the print data on a sheet (printing process).

The operation panel 104 includes a display unit 141, which is a flat liquid crystal monitor; and an operation unit 142 including physical buttons and a touch panel stacked on the display unit 141. A conveying unit 102 includes a conveyance path R1 and conveys sheets to each unit of the image forming apparatus 100 by rotating rollers (not shown) according to an instruction of the control unit 110.

The regular cassettes 111, 113, and 114 and the reuse cassette 112 illustrated in FIG. 3 are as described above, and the size of sheets to be stored in each cassette is described in parentheses in FIG. 3. In the present example, the regular cassette 111 and the reuse cassette 112 store sheets of the same size (e.g., A4 size). Further, the regular cassette 113 stores B5-size sheets and the regular cassette 114 stores A3-size sheets. The setting of the sheet size of each cassette will be described with reference to FIGS. 6A, 6B, and 7 described below. Moreover, the scanning unit 105, the post-processing device 160, the image forming unit 115, and the heater 121 are configured as described above.

Further, a functional unit including the communication unit 116 and the operation panel 104 is referred to as a receiving and notifying unit 250 (a receiving unit and a notifying unit). The receiving and notifying unit 250 receives a value (set value) set on the operation panel 104 by a user. Moreover, the receiving and notifying unit 250 receives a set value from an external personal computer via the communication unit 116. For example, the receiving and notifying unit 250 receives a setting of whether or not to perform a switching operation. The details of the receiving operation will be described below using an example of a pattern via the operation panel 104. Further, the receiving and notifying unit 250 displays (notifies) a message to the user via the operation panel 104. The receiving and notifying unit 250 also transmits (notifies) a message to the external personal computer via the communication unit 116. The message notification performed by the receiving and notifying unit 250 via operation panel 104 will be described below.

As an example of an operation carried out by the receiving and notifying unit 250, an operation caused by the operation panel 104 will be mainly described, but this can be also applied to an operation caused by the communication unit 116. In this case, the communication unit 116 receives an instruction for executing a job or data related to set values from the external personal computer or the like. Further, the communication unit 116 notifies the external personal computer or the like of the message. Moreover, the display or the notification can be also applied to the operation in which the communication unit 116 transmits layout data of the setting screen or the like or an icon image for display to the external personal computer and then the external personal computer displays the setting screen or the like.

Next, an automatic switching function of the present embodiment will be described with reference to FIGS. 4A to 5B. Further, the operation described in FIGS. 4A to 5B is a basis operation of the present embodiment.

Figure 4A:
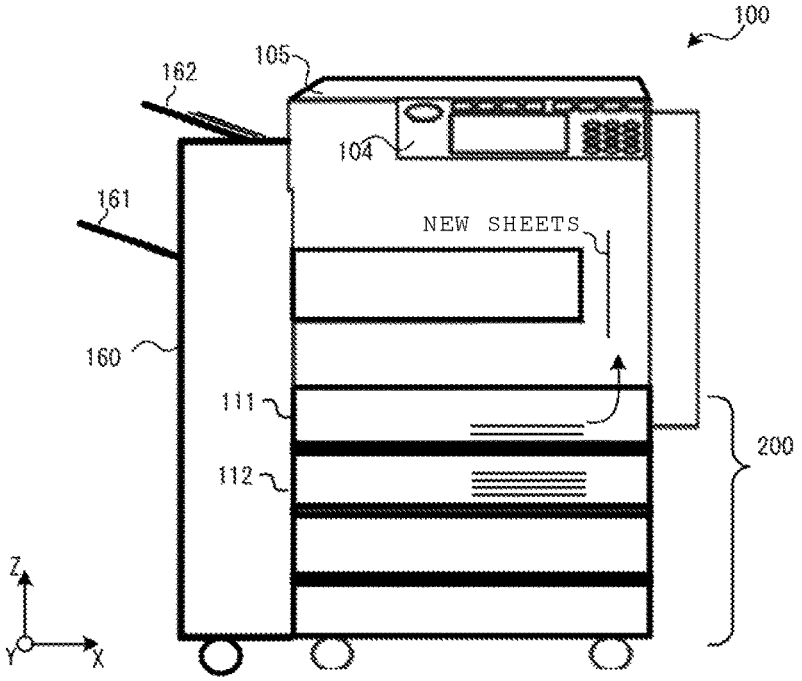
FIGS. 4A and 4B illustrate sheet feeding when an automatic switching function is enabled and post-processing is not performed.
Figure 4B:
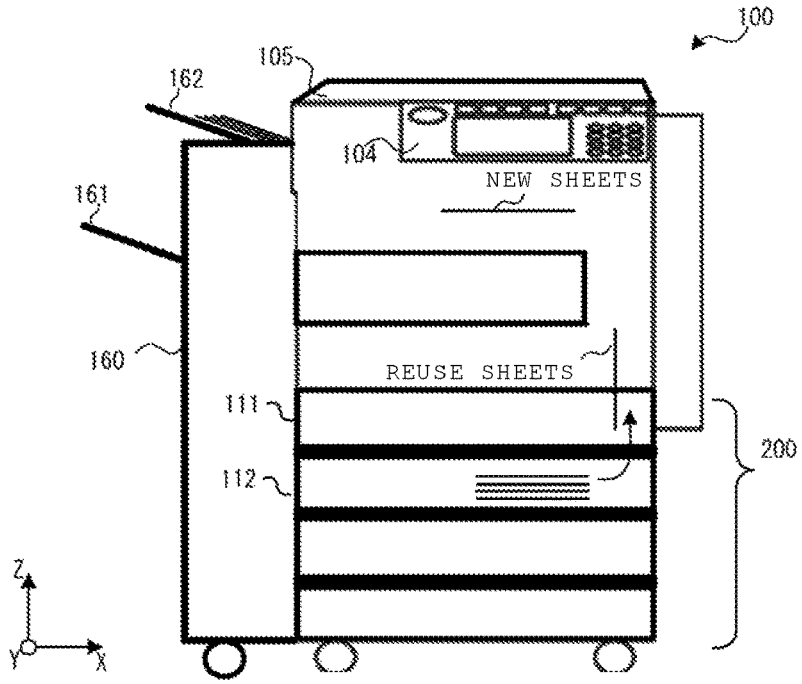

FIGS. 4A and 4B illustrate sheet feeding when the automatic switching function is enabled and a job that does not include post-processing is performed. When the image forming apparatus 100 receives a job (a copy job, a print job, or the like) of forming an A4-size image, which does not include post-processing, the image forming apparatus 100 operates to feed sheets used for an image forming process from the regular cassette 111 assuming that the regular cassette 111 is set to store new sheets (see FIG. 4A). When the regular cassette 111 runs out of new sheets during the execution of the job, the image forming apparatus 100 controls one or more reuse sheets to be continuously fed from the reuse cassette 112 according to the automatic switching function (see FIG. 4B).

Figure 5A:
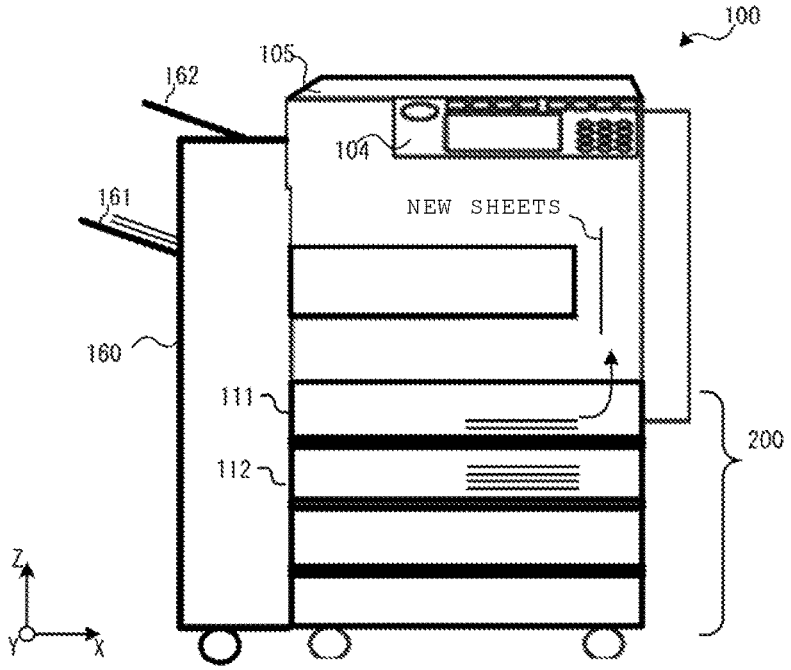
FIGS. 5A and 5B illustrate sheet feeding when the automatic switching function is enabled and the post-processing is performed.
Figure 5B:
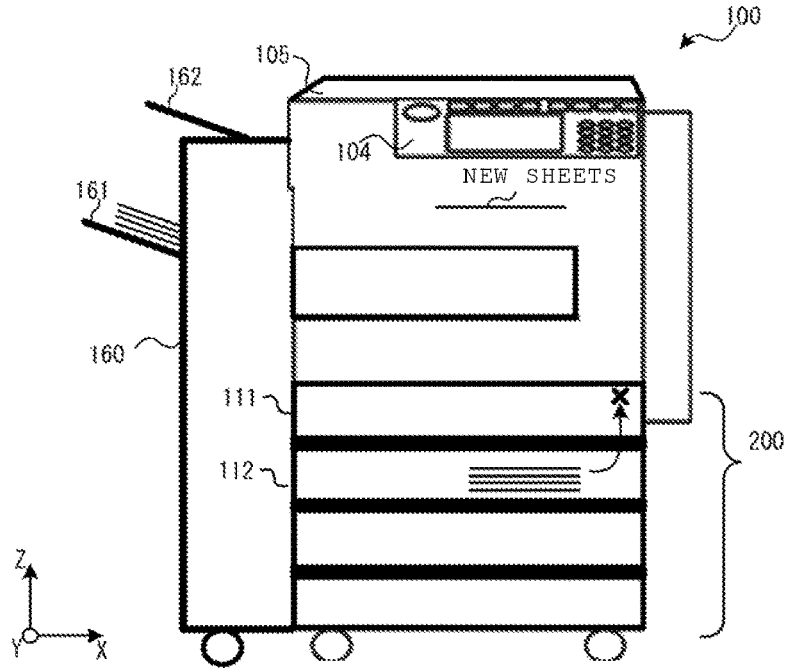

FIGS. 5A and 5B illustrate sheet feeding when the automatic switching function is enabled and a job including the post-processing is performed. When the image forming apparatus 100 receives a job (a copy job, a print job, or the like) of forming an A4-size image, which includes post-processing after the image forming process, the image forming apparatus 100 operates to feed sheets used for the image forming process from the regular cassette 111 assuming that the regular cassette 111 is set to store new sheets (see FIG. 5A). Further, in the description below, the "job of forming an A4-size image, which includes execution of post-processing after the image forming process" is also simply noted as the "job including post-processing".

When the regular cassette 111 runs out of new sheets during the execution of the job, the image forming apparatus 100 suspends the job and prohibits feeding of reuse sheets from the reuse cassette 112 (see FIG. 5B). That is, in the present embodiment, an automatic switching operation to switch a cassette to the one that stores the reuse sheets is not performed even when new sheets are run out during the execution of the image forming job.

A reuse sheet, on which an image is formed plural times, has a plurality of toner layers stacked thereon as described above even when the images on the sheet are in a decolored state. Due to the toner layers, when the positions of holes made by punching are shifted from a prescribed position, or the sheets are not aligned properly during stapling, each post-processing may not be performed precisely. Further, since reuse sheets are sheets on which the printing process and the decoloring process are performed at least once, the sheets are not in an excellent state. This also may prevent precise post-processing.

From the above-described viewpoint, in the present embodiment, switching from new sheets to reuse sheets is not performed, for example, even when the automatic switching operation function is enabled.

Moreover, in a case that both of the cassettes 111 and 112 store new sheets, the operation shown in FIGS. 4A and 4B is carried out so that sheet switching is performed using the automatic switching operation function whether or not the job includes post-processing.

Figure 6A:
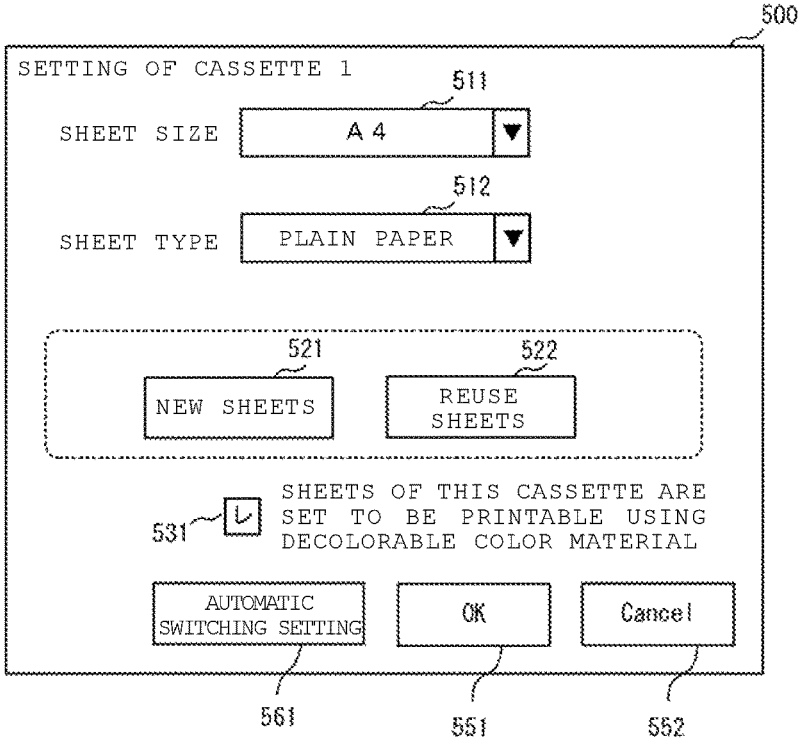
FIGS. 6A and 6B illustrate a setting screen of a cassette.
Figure 6B:
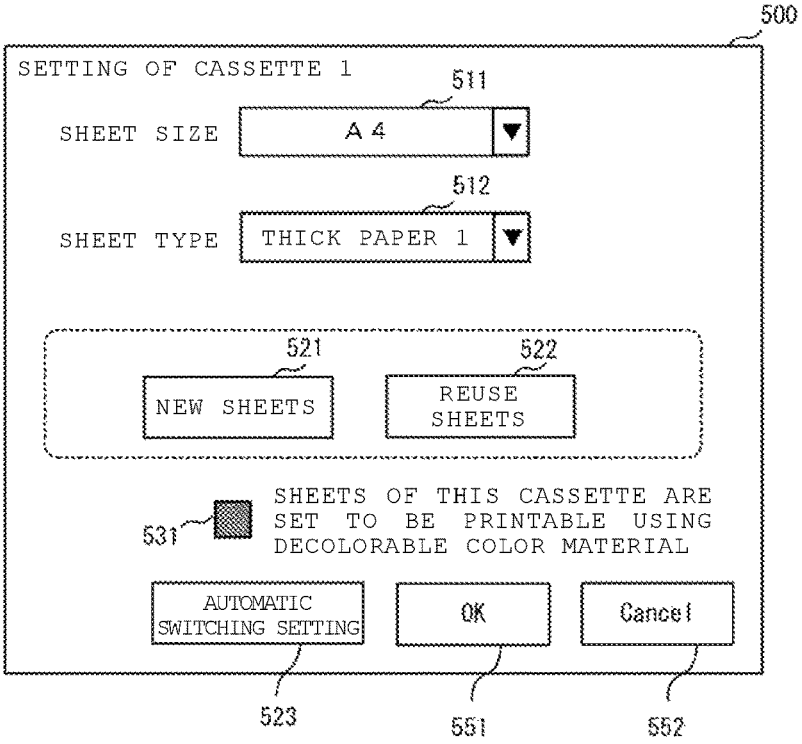

FIGS. 6A and 6B show an example of a screen for setting a sheet size or the like of sheets stored in a cassette. The control unit 110 displays a cassette setting screen 500 shown in FIG. 6A on the operation panel 104 in accordance with a prescribed operation of an administrator. In the present example, it is possible to set parameters different for each of the cassettes 111 to 114 using the cassette setting screen 500. In other words, the administrator can cause the cassette setting screen 500 to display for each of the cassettes 111 to 114 and make settings for each of the cassettes 111 to 114 with different values.

A size setting column 511 is a pull-down menu for setting the sheet size such as A4, A4-R, A3, or B5. A type setting column 512 is a pull-down menu for setting the type of sheets. In the type setting column 512 of the present example, plain paper, and thick paper 1 and thick paper 2 which are thicker than plain paper can be selected and then set. The thickness of the thick paper 1 is different from the thickness of the thick paper 2. In addition, OHP sheets or sheets made of special materials may be selected.

A new sheet button 521 and a reuse sheet button 522 are operation buttons for exclusively designating whether the sheets to be stored in the present cassette are new sheets or reuse sheets. When the administrator selects the new sheet button 521, the control unit 110 assumes that the cassette is used to store new sheets. When the administrator selects the reuse sheet button 522, the control unit 110 assumes that the cassette is used to store reuse sheets.

A decoloring toner print execution setting field 531 is a check box for designating whether to execute printing with a decolorable color material with respect to sheets stored in the cassette. When the decoloring toner print execution setting field 531 is marked, the control unit 110 permits printing using the decolorable color material with respect to sheets in the cassette. When the decoloring toner print execution setting field 531 is not marked, the control unit 110 prohibits printing using the decolorable color material with respect to sheets in the cassette.

In addition, when an image is printed on a thick paper sheet using a decolorable color material, decoloring failure may occur due to heat not passing through the sheet during a heating and decoloring process. For that reason, when any of the thick paper 1 or the thick paper 2 is selected by the type setting column 512 or paper other than plain paper is selected, the control unit 110 grays out the decoloring toner print execution setting field 531 as shown in FIG. 6B so as not to allow marking. In this manner, a setting is made so that decolorable printing is prohibited from being performed for the sheets stored in the cassette.

When an OK button 551 is selected, the control unit 110 controls the memory unit 182 to store designated values of respective items and carries out display switching such that the screen returns to the previous screen. When a cancel button 552 is selected, the setting made so far is cancelled and the screen returns to the previous screen.

Figure 7:
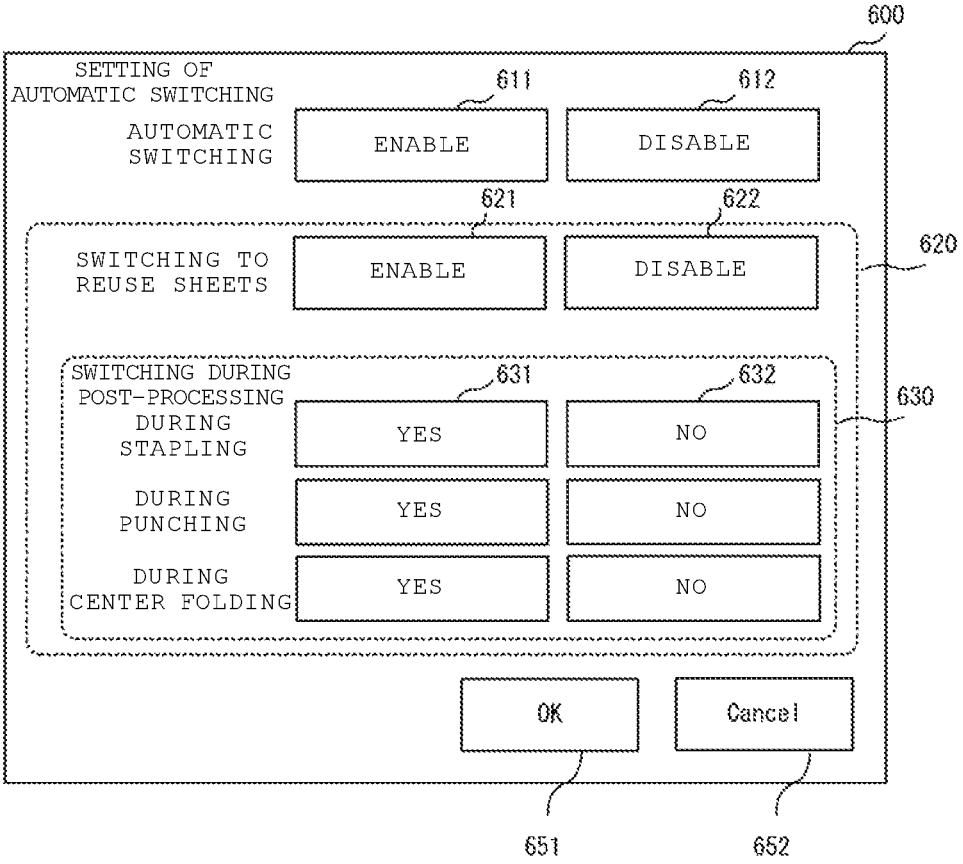
FIG. 7 illustrates a setting screen of an automatic switching function.

Further, when the automatic switching operation setting button 523 is selected on the screen shown in FIG. 6A, the control unit 110 displays an automatic switching operation setting screen 600 shown in FIG. 7 on the operation panel 104. Moreover, in the present example, the setting related to the automatic switching function is made not for each cassette but for the entire paper feeding operations of the image forming apparatus 100. Alternatively, the automatic switching operation setting screen 600 of FIG. 7 may be displayed each time the user executes a job.

The automatic switching operation setting screen 600 includes an enable button 611 and a disable button 612 for selecting whether to enable the automatic switching function.

When the enable button 611 is selected, the control unit 110 automatically switches the cassette with another cassette during paper feeding and the paper feeding is continued in a case where the cassette runs out of sheets and another cassette stores sheets having the same size as the sheets of the cassette. When the enable button 611 is selected, the automatic switching operation becomes the basic operation (default operation). Meanwhile, when the disable button 612 is selected, the control unit 110 performs an operation of temporarily suspending the job if the cassette runs out of sheets during paper feeding and notifying the user that the sheets are run out.

The setting items in a broken line frame 620 are operable when the enable button 611 is selected. Meanwhile, when the disable button 612 is selected, the setting items in the broken line frame 620 are not operable. The broken line frame 620 includes an enable button 621 and a disable button 622 for designating whether to enable or disable switching sheets with reuse sheets. When the enable button 621 is selected, the control unit 110 controls setting such that the automatic switching operation of the cassette with another cassette storing reuse sheets can be carried out. Meanwhile, when the disable button 622 is selected, the control unit 110 controls setting such that the automatic switching operation of switching the cassette with another cassette storing reuse sheets is prohibited and the job is suspended.

The setting items in a broken line frame 630 are items which are operable when the enable button 621 is selected. Buttons 631 and 632 are buttons for setting whether or not to perform automatic switching operation for each post-processing of stapling, punching, and the center folding process. For example, in a case where the enable button 631 of stapling is selected, the control unit 110 performs the automatic switching operation even when the post-processing of stapling is executed. Further, in a case where the enable button 631 of stapling is selected, the control unit 110 prohibits automatic switching operation when the post-processing of stapling is executed. The same applies to the buttons of the punching and the center folding process.

As shown in FIG. 7, in the present example, it is possible to set whether or not to perform the automatic switching operation individually for each post-processing of stapling, punching, and the center folding process. For example, it is possible to make setting such that the automatic switching operation of switching sheets with reuse sheets is not carried out in a case of stapling and punching and to make setting such that the automatic switching operation of switching sheets with reuse sheets is carried out in a case of the center folding process.

When the setting shown in FIG. 7 is finished and an OK button 651 is selected, the control unit 110 controls the memory unit 182 to store values of respective items designated by the user and the screen to return to the cassette setting screen 500 shown in FIG. 6A. When a cancel button 652 of FIG. 7 is selected, the setting made so far is cancelled and the screen returns to the cassette setting screen 500 shown in FIG. 6A.

Figure 8:
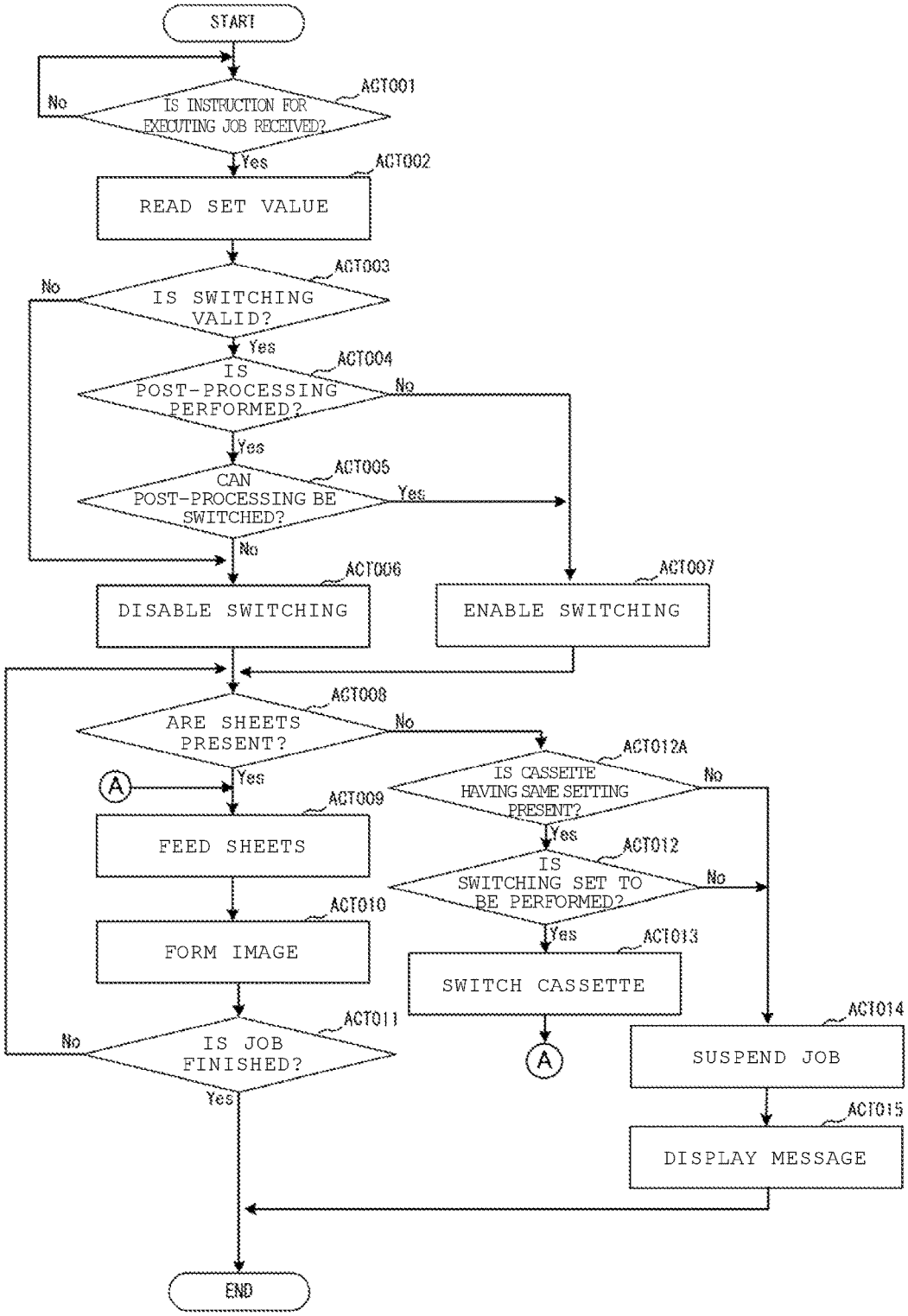
FIG. 8 is a flowchart showing a process of an operation carried out by the image forming apparatus.

FIG. 8 is a flowchart focusing on the automatic switching operation carried out when the image forming apparatus 100 executes a job. The flowchart shown in FIG. 8 illustrates an operation of the processor 181 executing arithmetic processing of the control program 183 stored in the memory unit 182. Here, it is assumed that the setting is performed in advance using screens 500 and 600 shown in FIGS. 6A, 6B, and 7, and that the respective set values are stored in the memory unit 182. In addition, the automatic switching operation is set to be an operation of starting paper feeding from the regular cassette 111 and switching the regular cassette 111 with the reuse cassette 112 when the regular cassette 111 runs out of sheets. That is, the automatic switching operation of switching new sheets with reuse sheets will be described with reference to FIG. 8.

The control unit 110 waits until an instruction for executing a job is received (loop of ACT001). The job here is assumed to be a job of performing image formation using the image forming unit 115, such as a copy job or a print job. Here, the job is referred to as an image forming job.

When the instruction for executing the job is received (ACT001: Yes), the control unit 110 reads the set values (values set through the automatic switching operation setting screen 600 of FIG. 7) related to the automatic switching operation, which are stored in the memory unit 182 (ACT002). The control unit 110 determines whether the automatic switching operation is enabled and the switching of new sheets with reuse sheets is enabled (ACT003). When the switching is set to be disabled (ACT003: No), the process proceeds to ACT006. When the switching is set to be enabled (ACT003: Yes), the control unit 110 determines whether the job includes post-processing (ACT004). In ACT004, the control unit 110 determines whether any post-processing of the stapling, the punching, and the center folding is set to be performed as parameters of the job. When the job includes no post-processing (ACT004: No), the automatic switching operation is set to be performed (ACT007). In this manner, the control unit 110 performs an operation of continuously supplying sheets from the reuse cassette 112 when the regular cassette 111 runs out of sheets.

When the job includes the post-processing (ACT004: Yes), the control unit 110 determines whether or not the post-processing included in the job is a type of a job that is set such that the cassette switching operation can be performed, by referring to the set values read in ACT002

(ACT005). For example, when the job includes the stapling, the control unit 110 determines whether the automatic switching operation is set to be performed during the stapling by referring to the set values read in ACT002. The same applies to the punching and the center folding.

When the post-processing included in the job is set such that the cassette switching operation can be performed (ACT005: Yes), the control unit 110 sets the automatic switching operation to be permitted (ACT007). Meanwhile, when the post-processing is set such that the cassette switching operation cannot be performed (ACT005: No), the control unit 110 sets the automatic switching operation not to be performed (ACT006). Information related to whether or not to permit automatic switching operation which is set in ACT006 and ACT007 is referred to as first information by the control unit 110. The first information is written in the memory unit 182 so as to be used for the control program 183.

Further, the process of the flowchart from ACT002 to ACT006 or ACT007 may be performed before the job is executed. For example, the process may be carried out after the OK button 651 of FIG. 7 is selected.

The control unit 110 determines whether the regular cassette 111 has at least one sheet (ACT008). This determination is made according to signals from a sensor for detecting the presence or absence of sheets, such as a weight sensor or a photoelectric sensor, which is disposed in the inside of the regular cassette 111.

When it is determined that the regular cassette 111 stores at least one sheet (ACT008: Yes), the control unit 110 causes one or more new sheets to be fed from the regular cassette 111 (ACT009) and forms an image on the new sheets (ACT010). Moreover, when the job includes the post-processing, the post-processing is performed after sheets are conveyed to the post-processing device 160.

The control unit 110 determines whether image forming of all page images is finished (ACT011). When it is determined that the image forming is not finished (ACT011: No), the process returns to ACT008 and the control unit 110 continues the process for the next page or the next sheet.

In ACT008, when it is determined that the regular cassette 111 runs out of sheets (ACT008: No), the control unit 110 determines whether or not there is a cassette having the same setting as the setting of the regular cassette 111 (ACT012A). The setting here includes the sheet size and the sheet type and are the ones settable through the cassette setting screen 500 shown in FIG. 6A.

When it is determined that there is no cassette having the same setting as the content of the regular cassette 111 (ACT012A: No), the process proceeds to ACT014 described below. Meanwhile, when it is determined that there is a cassette having the same setting as the setting of the regular cassette 111 (ACT012A: Yes), the control unit 110 refers to first information stored in the memory unit 182 and determines whether or not the cassette is set such that automatic switching operation is permitted (ACT012). When it is determined that the automatic switching operation is set to be permitted (ACT012: Yes), the control unit 110 switches a paper feed cassette with the reuse cassette 112 and feeds one or more sheets from the reuse cassette 112 so that images are continuously formed on the sheets (to ACT009). When it is determined that the automatic switching operation is set to be prohibited (ACT012: No), the control unit 110 suspends the job (ACT014) and displays a message that the regular cassette 111 runs out of sheets on the operation panel 104 (ACT015). Further, the notification here is performed by displaying a message on the screen, but the notification can be performed through voice reproduction of a predetermined message or voice notification by emitting a buzzer sound.

In the present embodiment, when the post-processing of stapling, punching, or center folding treatment is set, the use of reuse cassette 112 storing reuse sheets is prohibited and only new sheets fed from a cassette storing new sheets are used for an image forming process.

According to the present embodiment, when sheets are run out, the printing process is suspended without performing the automatic switching operation assuming that cassettes run out of sheets even when sheets remain in the reuse cassette 112. This operation can be performed by selecting the button 622, which disables the switching to reuse sheets, on the automatic switching operation setting screen 600 shown in FIG. 7.

According to the present embodiment, the automatic switching operation to switch to the reuse cassette 112 can be performed by selecting the button 621, which enables the switching to reuse sheets, on the automatic switching operation setting screen 600 shown in FIG. 7. Further, since it is possible to set whether to switch the cassette according to the type of the post-processing to be performed, the image forming apparatus can be operated in a manner desired by the user.

In addition, particularly in a case of internal documents for which precision the post-processing is not required or a case where the post-processing may be performed because reuse sheets are already used several times and are not to be reused any more, the reuse sheets may be used. This process can be realized by selecting the button 621, which enables switching to reuse sheets, on the screen 600 shown in FIG. 7 and enabling the operation of stapling, punching, or center folding by selecting the buttons 631 (button indicating "Yes") on the screen 600.

Moreover, in the present embodiment, the image forming apparatus 100 has the display unit 141. However, the display unit 141 may be separately provided from the image forming apparatus 100. For example, a screen of a client PC connected to the image forming apparatus 100 via a wired or wireless network may be used as the display unit.

As described above, according to the technique described in the specification, it is possible to provide high-quality documents.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a first sheet storage;

a second sheet storage;

an image forming unit;

a sheet conveyer configured to convey sheets from the first and second sheet storages to the image forming unit; and a controller configured to set a type of sheets stored in the first sheet storage as new sheets and a type of sheets stored in the second sheet storage as image-decolored sheets, and when the first sheet storage runs out of sheets during execution of an image forming job, switch a sheet feeding source from the first sheet storage to the second sheet storage if the image forming job includes no sheet post-processing, and stop image forming by the image forming unit if the image forming job includes sheet post-processing.

2. The apparatus according to claim 1, wherein the controller is further configured to set whether or not to allow switching of the sheet feeding source for each of a plurality of types of sheet post-processing, and the sheet post-processing included in the image forming job is a type of sheet post-processing for which the switching of the sheet feeding source is not allowed.

3. The apparatus according to claim 2, further comprising:

an operation panel operable by a user, wherein the controller sets whether or not to allow the switching of the sheet feeding source for a type of sheet post-processing, based on a user input on the operation panel.

4. The apparatus according to claim 3, wherein the operation panel includes a first set of selectable objects for designating whether or not to allow switching of the sheet feeding source globally for the plurality of types of sheet post-processing.

5. The apparatus according to claim 4, wherein the operation panel also includes a plurality of second sets of selectable objects, each of the second sets being for designating whether or not to allow switching of the sheet feeding source individually for one of the plurality of types of sheet post-processing.

6. The apparatus according to claim 5, wherein the controller is further configured to enable selection of the second sets of selectable objects when the first set of selectable objects is operated to allow switching of the sheet feeding source.

7. The apparatus according to claim 5, wherein the controller is further configured to disable selection of the second sets of selectable objects when the first set of selectable objects is operated to not allow switching of the sheet feeding source.

8. The apparatus according to claim 1, further comprising:

an operation panel operable by a user, wherein the controller sets the types of sheets stored in the first and second sheet storages based on user inputs on the operation panel.

9. The apparatus according to claim 1, further comprising:

a display, wherein the controller is further configured to control the display to display a message that the first sheet storage ran out of sheets when the image forming for the image forming job is stopped.

10. The apparatus according to claim 1, wherein the sheet post-processing in the image forming job includes one or more of stapling, folding, and punching.

11. A method of controlling an image forming apparatus that includes a first sheet storage, a second sheet storage, and an image forming unit, the method comprising:

setting a type of sheets stored in the first sheet storage as new sheets and a type of sheets stored in the second sheet storage as image-decolored sheets;

conveying one or more sheets from the first sheet storage to the image forming unit; and when the first sheet storage runs out of sheets during execution of an image forming job, switching a sheet feeding source from the first sheet storage to the second sheet storage if the image forming job includes no sheet post-processing, and stopping image forming by the image forming unit if the image forming job includes sheet post-processing.

12. The method according to claim 11, further comprising:

setting whether or not to allow switching of the sheet feeding source for each of a plurality of types of sheet post-processing, wherein the sheet post-processing included in the image forming job is a type of sheet post-processing for which the switching of the sheet feeding source is not allowed.

13. The method according to claim 12, wherein setting of whether or not to allow the switching of the sheet feeding source for a type of sheet post-processing is made based on a user input on an operation panel.

14. The method according to claim 13, wherein the operation panel includes a first set of selectable objects for designating whether or not to allow switching of the sheet feeding source globally for the plurality of types of sheet post-processing, and setting of whether or not to allow the switching of the sheet feeding source for each of the plurality of types of sheet post-processing is made based on a user selection of the first set of selectable objects.

15. The method according to claim 14, wherein the operation panel also includes a plurality of second sets of selectable objects, each of the second sets being for designating whether or not to allow switching of the sheet feeding source individually for one of the plurality of types of sheet post-processing, and setting of whether or not to allow the switching of the sheet feeding source for each of the plurality of types of sheet post-processing is made based on user selection of the second sets of selectable objects.

16. The method according to claim 15, further comprising:

enabling selection of the second sets of selectable objects when the first set of selectable objects is operated to allow switching of the sheet feeding source.

17. The method according to claim 15, further comprising:

disabling selection of the second sets of selectable objects when the first set of selectable objects is operated to not allow switching of the sheet feeding source.

18. The method according to claim 11, wherein setting of the types of sheets stored in the first and second sheet storages is made based on a user input on an operation panel operable by a user.

19. The method according to claim 11, further comprising:

controlling a display to display a message that the first sheet storage ran out of sheets when the image forming for the image forming job is stopped.

20. The method according to claim 11, wherein the sheet post-processing in the image forming job includes one or more of stapling, folding, and punching.

* * * * *